US007748449B2

(12) United States Patent
Bussear et al.

(10) Patent No.: US 7,748,449 B2
(45) Date of Patent: Jul. 6, 2010

(54) TUBINGLESS ELECTRICAL SUBMERSIBLE PUMP INSTALLATION

(75) Inventors: Terry R. Bussear, Spring, TX (US); Grant F. Smith, Tulsa, OK (US)

(73) Assignee: Baker Hughes Incorporated, Houston, TX (US)

( * ) Notice: Subject to any disclaimer, the term of this patent is extended or adjusted under 35 U.S.C. 154(b) by 522 days.

(21) Appl. No.: 11/680,429

(22) Filed: Feb. 28, 2007

(65) Prior Publication Data

US 2008/0202748 A1 Aug. 28, 2008

(51) Int. Cl.
*E21B 47/10* (2006.01)
*E21B 43/00* (2006.01)

(52) U.S. Cl. ..... 166/250.08; 166/106; 166/107; 166/68.5; 166/66.4

(58) Field of Classification Search ..... 166/387, 166/133, 134, 105, 106, 107, 68.5, 69, 182, 166/188, 250.08, 66.4, 370; 417/423.3; 415/901
See application file for complete search history.

(56) References Cited

U.S. PATENT DOCUMENTS 3,967,448 A * 7/1976 Matthews ..... 60/641.4
4,350,205 A * 9/1982 Goldschild et al. ..... 166/375
4,440,221 A * 4/1984 Taylor et al. ..... 166/106
4,537,257 A * 8/1985 Todd ..... 166/369
5,009,264 A * 4/1991 Sliger et al. ..... 166/106
5,361,834 A 11/1994 Cox
5,478,970 A 12/1995 Lawler et al.
5,670,747 A 9/1997 Lawer et al.
5,971,069 A 10/1999 Stoy et al.
6,082,454 A 7/2000 Tubel
6,092,599 A 7/2000 Berry et al.
6,092,600 A 7/2000 McKinzie et al.
6,123,149 A 9/2000 McKinzie et al.
6,131,660 A 10/2000 Stuebinger et al.
6,179,056 B1 1/2001 Smith
6,192,983 B1 2/2001 Neuroth et al.
6,227,301 B1 5/2001 Edwards et al.
6,325,143 B1 12/2001 Scarsdale
6,328,111 B1 12/2001 Bearden et al.
6,352,113 B1 3/2002 Neuroth
6,615,926 B2 9/2003 Hester et al.
6,684,956 B1 2/2004 Berry
6,702,015 B2 3/2004 Fielder, III et al.
6,873,267 B1 3/2005 Tubel et al.
6,923,275 B2 8/2005 Gardes

* cited by examiner

*Primary Examiner*—Kenneth Thompson
(74) *Attorney, Agent, or Firm*—Bracewell & Giuliani LLP

(57) ABSTRACT

A method of producing a well utilizes a submersible pump run on a line, such as braided wire rope, that includes power conductors. The operator sets a packer in the casing, the packer having a check valve and a tieback receptacle. The operator pressure tests the integrity of the casing above the packer, and if it passes, then runs the pump assembly on the line. The pump assembly has a shroud with a downward extending extension that seals to the passage of the packer. If the pressure test of the casing fails, the operator runs a liner into the well and engages the tieback receptacle. A smaller diameter pump is then lowered on a line into the liner and into engagement with the packer.

20 Claims, 3 Drawing Sheets

TUBINGLESS ELECTRICAL SUBMERSIBLE PUMP INSTALLATION

FIELD OF THE INVENTION

This invention relates in general to electrical submersible well pumps, and in particular to a method of installing and retrieving a well pump without the use of tubing.

BACKGROUND OF THE INVENTION

Wells that lack sufficient formation pressure to flow fluid in commercial quantities to the surface utilize some type of artificial lift. One type of artificial lift employs an electrical pump that is lowered into the well for producing the well fluid. The pump is typically a rotary pump driven by a submersible electrical motor. The pump may be a centrifugal type having a large number of stages of impellers and diffusers. Alternately, the pump may be of another rotary type, such as a progressing cavity pump. Submersible rotary pumps generally are referred to herein as "ESP's".

Typically, an ESP is secured to the lower end of a string of production tubing made up of joints of pipe secured together by threads. The tubing is lowered into the well along with the pump, and the power cable to the motor is strapped alongside the tubing. Normally the well is cased and has perforations that allow well fluid to flow into the casing. The intake of the pump is in communication with the well fluid in the casing, and the discharge of the pump is into the tubing.

One disadvantage of an ESP installed on production tubing is the time and equipment needed to install and retrieve a tubing supported ESP. It is not uncommon to pull an ESP for repair or replacement every year and a half or so, depending upon the type of well fluid and operating conditions.

Although not common, techniques are known in the prior art for installing an ESP such that the ESP could be retrieved without pulling a string of tubing. An ESP cannot be suspended on conventional ESP power cable, which lacks adequate strength to support its own weight and the weight of an ESP in a well. Special strengthening techniques must be employed. For example, one type of installation employs coiled tubing to support the weight of the pump. Coiled tubing comprises metal, continuous tubing that is deployed from a large reel of a coiled tubing injector. Normally the pump discharge does not lead to the interior of the coiled tubing, because if so, the coiled tubing would need a fairly large diameter, which would require a larger coiled tubing injector and greater expense for the coiled tubing. If the cable is installed within the coiled tubing, the pump may discharge into the casing surrounding the coiled tubing if the casing is in good condition. The casing may have holes or cracks that cause leakage of the well fluid into the surrounding environment, particularly if the casing is in an old well. This leakage could cause contamination of fresh water zones. If the casing leaks, it is known that the operator could install a liner in the casing to prevent such occurrence.

SUMMARY OF THE INVENTION

In the method of this invention, the operator first installs a packer having a passage extending through it and a valve. The packer has a tieback receptacle located on its upper end. After the packer has been set, the operator supplies fluid pressure to the well above the casing to determine if the casing leaks. The valve in the packer is preferably a check valve that prevents downward flow of well fluid but allows upward flow through the passage. Consequently, the test pressure is applied only to the portion of the casing above the perforations and does not enter the formation.

If the test is successful, the operator lowers an ESP into the well on a line and engages an intake portion of the pump with the passage in the packer. Preferably, the line comprises a cable or wire rope braided around the power conductors to provide strength. The ESP in the preferred embodiment has a shroud surrounding the motor and pump, the shroud having a lower extension that slides into sealing engagement with the passage in the packer. The operator supplies power to the ESP, which causes well fluid to flow from below the passage through the valve and to the surface. The mating features of the lower extension with the packer include an anti-rotation member to counter torque. Once engaged, the packer supports the weight of the ESP and transfers down thrust to the casing.

If the test of the casing pressure indicated leakage existed, rather than running the ESP, the operator would first run a string of conduit, such as a liner, into engagement with the tieback receptacle on the packer. The operator would then lower on a line through the tieback conduit a different ESP, one of smaller diameter. The smaller diameter ESP also has an extension that engages the passage in the packer in the same manner as the larger diameter ESP. The operator would supply power to cause the ESP to produce the well fluid up through the tieback conduit rather than through the casing.

To retrieve the pump for repair or replacement, the engagement between the ESP and packer allows the operator to simply pull upward on the line, which causes the pump shroud to disengage from the passage in the packer. If the ESP fails to move upward from the packer, an over pull on the line causes it to part or release at the ESP, allowing the line to be reeled back onto a winch. The operator could then run back into the casing with a fishing tool to engage and retrieve the ESP. Rather than a fishing tool, if a liner has been installed, the operator can rotate the liner to release the packer from engagement with the casing. The operator could then pull the liner and packer to the surface, bringing along with them the ESP.

DETAILED DESCRIPTION OF THE INVENTION

Figure 1:
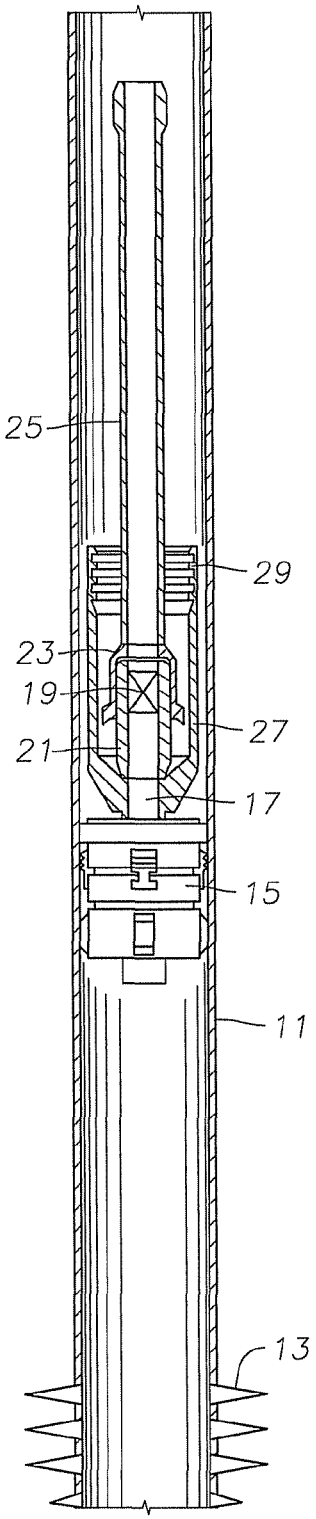
FIG. 1 is a sectional view showing a packer assembly being lowered into casing of a well in accordance with this invention.

Referring to FIG. 1, a string of casing 11 is schematically illustrated in FIG. 1 in a well. Casing 11 has been cemented in place and has perforations 13 that admit well fluid. Normally, the well would lack sufficient formation pressure to flow to the surface in commercial quantities. A packer 15 having an upward extending tubular member, referred to as lug nipple 21, is shown being lowered into casing 11. Packer 15 is a conventional member that has a passage 17 extending from its lower end through lug nipple 21. A valve 19 is located within passage 17 in lug nipple 21. Preferably, valve 19 is a check valve that freely allows upward flow but prevents downward flow; it may also have an equalizing feature that when actuated, allows downward flow. As an alternative to a check valve, a valve that has a closed position and an open position, such as a hydraulically actuated ball valve or sliding sleeve, might be utilized.

Figure 4:
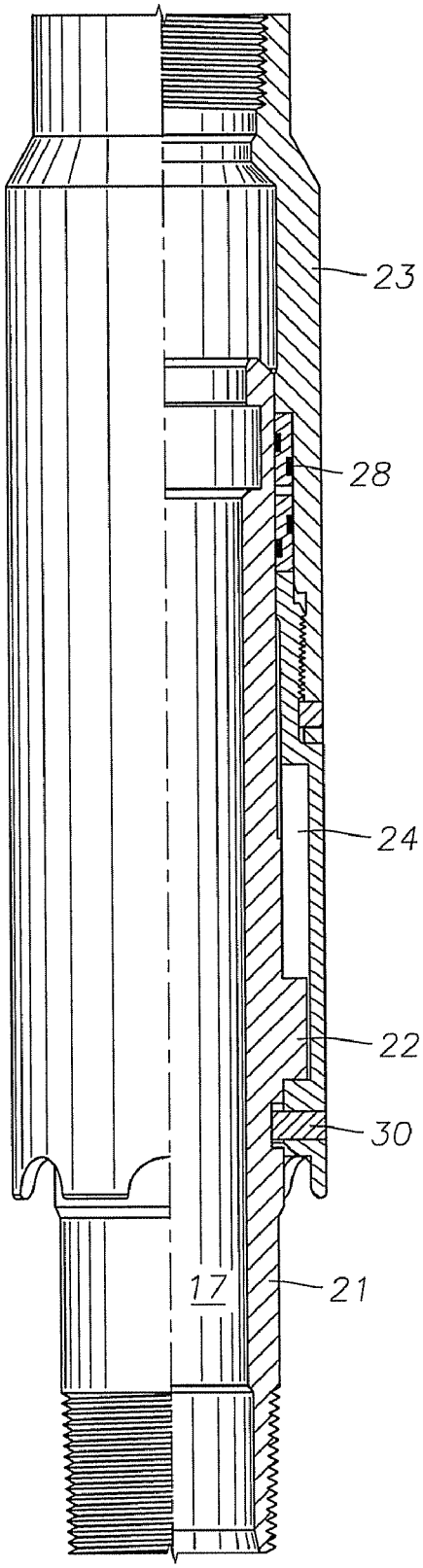
FIG. 4 is an enlarged sectional view of an overshot tool of the packer running string engaging a lug nipple of the packer assembly of FIG. 1.
Figure 5:
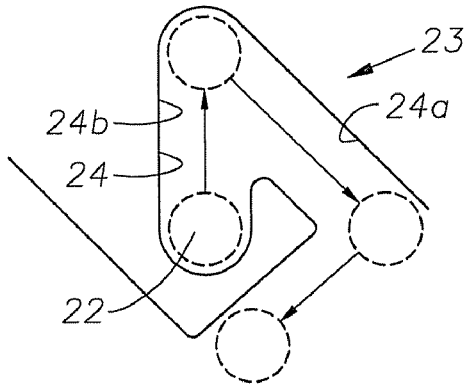
FIG. 5 is a schematic illustration of a portion of the overshot tool of FIG. 4, illustrating a J-slot arrangement for engaging a lug of the packer assembly of FIG. 1.
Figure 6:
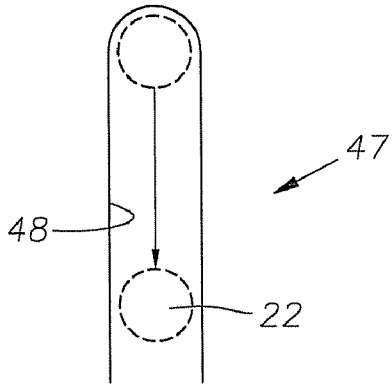
FIG. 6 is a schematic illustration of a portion of the extension member of the shroud of the ESP of FIG. 3, showing a vertical slot in engagement with a lug on the lug nipple of the packer assembly of FIG. 1.

Referring to FIG. 4, lug nipple 21 has radially outward protruding pins or lugs 22 (only one shown) on its side wall for being engaged by an overshot tool 23 secured to the lower end of a running string 25 (FIG. 1). Running string 25 may be drill pipe, a string of production tubing, or coiled tubing. Overshot tool 23 slides over lug nipple 21 and has J-slots 24 that engage lugs 22. As shown in FIG. 5, each J-slot 24 has an angled entry portion 24*a* and a load bearing portion 24*b* to retain packer 15 (FIG. 1) and transmit rotation to set the slips of packer 15. Overshot tool 23 also preferably has an annular seal 28 that seals against lug nipple 21. An optional shear pin 30 may be employed to retain lugs 22 in the load bearing portion 24*b* of J-slot 24 while packer 15 is being run. After packer 15 is set, shear pin 30 shears when running string 25 is being retrieved.

Packer 15 has a tieback receptacle 27 secured to its upper end. Tieback receptacle 27 is a tubular member of larger diameter than lug nipple 21 and extends around and above lug nipple 21. Tieback receptacle 27 has an internal profile, such as threads 29, on its upper end.

Running string 25 sets packer 15 in a conventional manner, which in one example, causes the slips of packer 15 to set by right-hand rotation and the elastomeric element of packer 15 to be energized by push or pull. After setting, the operator tests casing 11 by applying fluid pressure to the portion of casing 11 above packer 15. Preferably, the operator retrieves running string 25 before performing the test, but the test could alternatively be performed with running string 25 still attached to packer 15. The fluid pressure acts against the portion of casing 11 above packer 15, but does not transmit below packer 15 to perforations 13 because the fluid pressure is blocked by check valve 19.

Figure 3:
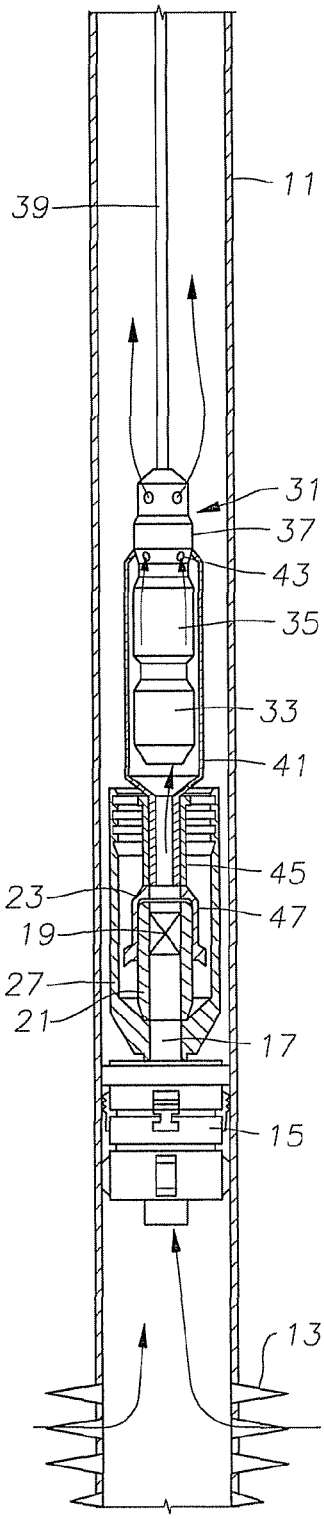
FIG. 3 is a schematic view illustrating an ESP lowered into engagement with the packer assembly of FIG. 1 for producing well fluid up the casing.

If the test is satisfactory, the operator will install an electrical submersible pump assembly (ESP) 31, as shown in FIG. 3. ESP 31 has a rotary pump 33 that typically comprises a centrifugal pump having a number of stages (not shown), each stage having an impeller and a diffuser. Pump 33 is connected on its lower end to a seal section 35. An electrical motor 37 is connected to the lower end of seal section 35. Motor 37 is preferably filled with a dielectric fluid, and seal section 35 equalizes the hydrostatic pressure of the well fluid on the exterior of motor 37 with the dielectric fluid in the interior.

A line 39 that includes a power cable for motor 37, is used to run ESP 31 into the well. Conventional ESP power cable is not able to support its own weight and the weight of an ESP. Preferably line 39 is a cable that comprises the three insulated power conductors sheathed in one or more wraps of braided wire. The braided wire sheath will support its own weight as well as the weight of ESP. Other strengthening features could be employed in addition, such as longitudinal, unidirectional carbon fibers. Preferably the braided wire sheath will connect to a rope socket within a fishing neck on the upper end of motor 37. The power conductors lead from line 39 at the fishing neck to motor 37 either through an electrical connector or other arrangement. In the event ESP 31 becomes stuck, an upward pull would break the braided wire sheath at the rope socket, which allows the operator to run back in with a tubular string and a fishing tool to retrieve ESP 31.

ESP 31 has a shroud 41 that is a tubular member extending around motor 37, seal section 35 and the portion of pump 33 above pump intake 43 and below the discharge of pump 33. Shroud 41 has a lower tubular extension 45 that extends downward for fluid communication with passage 17 in packer 15. In the preferred embodiment, an overshot tool 47 secures to tubular extension 45 and engages lug nipple 21. Overshot tool 47 comprises a tubular member with a seal similar to overshot tool 23 for sliding over and sealing to lug nipple 21. Unlike overshot tool 23, the slots 48 of overshot tool 47 extend straight upward from the lower edge of overshot tool 23. Preferably there is no latch mechanism between overshot tool 47 and lugs 22, allowing overshot tool 47 to disengage from lug nipple 21 by a straight upward pull. After ESP 31 lands on packer 15, packer 15 will support the weight of ESP 31 and tension in line 39 can be reduced.

When electrical power is supplied to pump motor 37 over the power conductors in line 39, it causes well fluid to flow from perforations 13, through passage 17, into shroud 41 and out into casing 11 to the surface. Motor 37 creates torque, and the torque is resisted by the engagement of slot 48 with lug 22. Lug nipple 21 and packer 15 transfer the torque to casing 11. The pumping action also creates downthrust, which transfers from ESP 31 to packer 15 and from packer 15 to casing 11.

To retrieve ESP 31 for repair or replacement, the operator simply exerts an upward pull on line 39, which disengages overshot tool 47 from lug nipple 21, allowing ESP 31 and its shroud 41 to be retrieved to the surface. While ESP 31 is disengaged from lug nipple 21, the column of well fluid in casing 11 will remain in place and will not flow downward because of check valve 19 (FIG. 1) within packer 15. The column of fluid provides a safety barrier to prevent any upward flow of fluid due to pressure in the producing formation.

Figure 2:
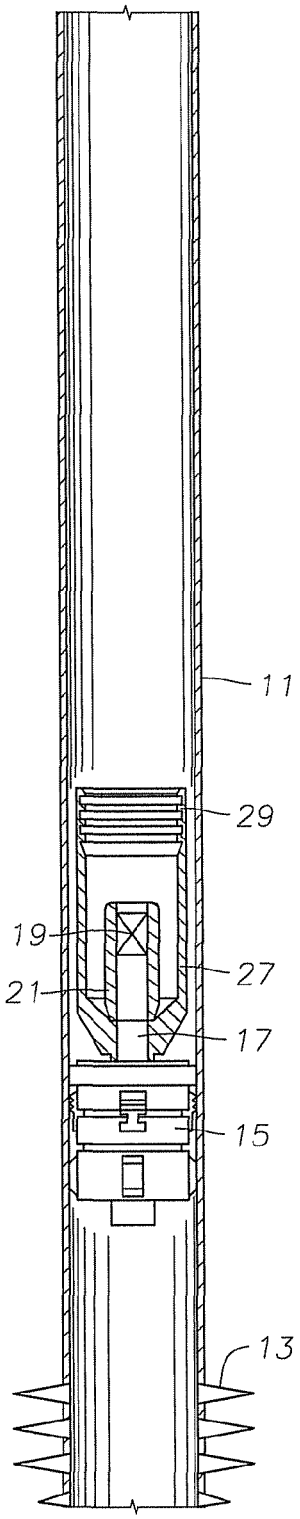
FIG. 2 is a sectional view of the packer assembly of FIG. 1 after setting.
Figure 7:
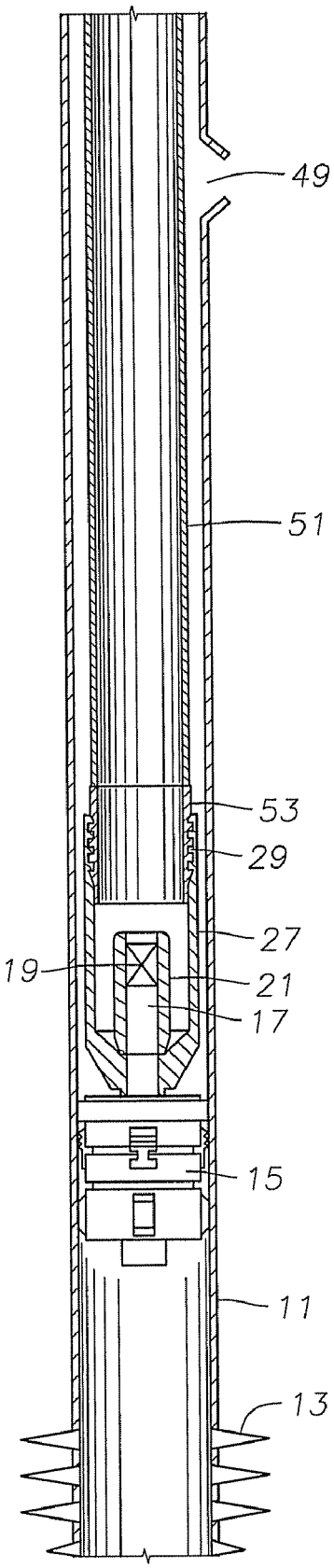
FIG. 7 is a sectional view schematically illustrating a casing with a leak, and a liner is secured to the tieback receptacle of the packer assembly of FIG. 1.

Referring to FIG. 2, if the pressure test illustrated in FIG. 2 indicated leakage of casing 11, the operator would not install ESP 31. FIG. 7 illustrates schematically a hole 49 in casing 11, causing it to fail the pressure test. The operator runs a conventional liner 51 into the well. Liner 51 normally comprises lengths of casing secured together by threads. Liner 51 has a conventional tieback connector 53 on its lower end that sealingly secures to tieback receptacle 27. Preferably tieback connector 53 has a ratcheting arrangement that engages threads 29 by straight downward movement so that there is no need to rotate liner 51 to connect it to tieback receptacle 27.

Figure 8:
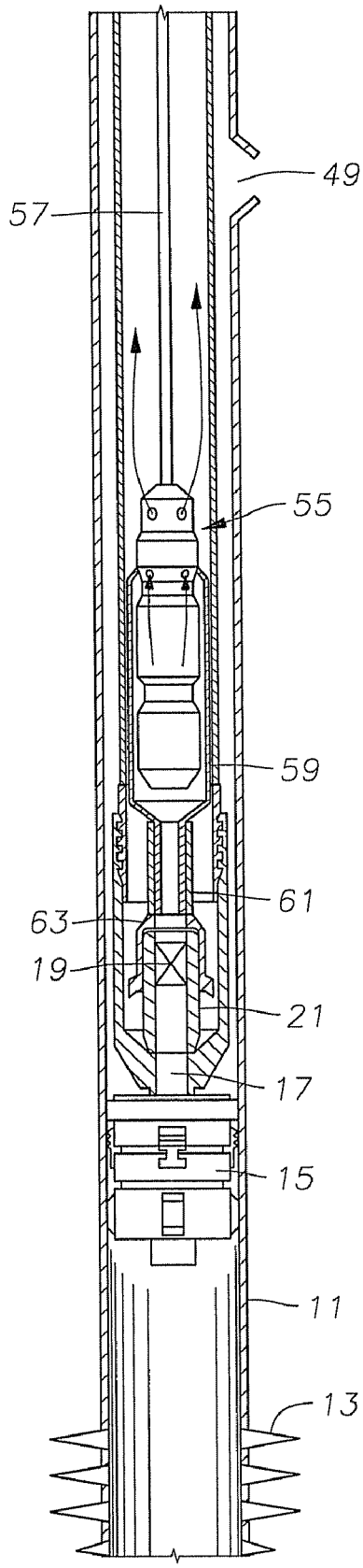
FIG. 8 is a sectional view illustrating a smaller diameter pump assembly lowered through the liner of FIG. 7 and in engagement with the packer assembly of FIG. 1 to produce well fluid through the liner.

Referring to FIG. 8, the operator would then lower an ESP 55 that is smaller in diameter than ESP 31 (FIG. 3). ESP 55 is also preferably run on a line 57 of the same type as line 39; that is line 57 includes a power cable preferably within braided wire rope. ESP 55 also has a shroud 59 with a tubular extension 61 on its lower end. An overshot tool 63 similar to overshot tool 47 connects to tubular extension 61 for engaging sealingly with lug nipple 21.

In the assembly of FIG. 8, power is supplied over the power conductors in line 57 to the motor of ESP 55, causing ESP 55 to pump well fluid up liner 51 to the surface. To repair or replace ESP 55, the operator exerts a pull on line 57 to disengage overshot 63 from lug nipple 21. It is possible that exerting a pull on line 57 will not cause overshot 63 to release from lug nipple 21. This could be due to a number of things including: sand buildup; lost parts or components. In that event, preferably the operator pulls line 57 sufficient to cause it to release from ESP 55 at the rope socket or weak point within fishing neck. After retrieving line 57, the operator could run a fishing tool in to retrieve ESP 55. Alternatively, the operator may rotate liner 51, which in turn rotates lug nipple 21 and causes the slips of packer 15 to release from engagement with casing 11. The operator then retrieves liner 51, bringing along with it packer 15 and ESP 55, which will remain inside liner 51 as liner 51 is pulled. The operator could then rerun packer 15, liner 51 and a repaired or replaced ESP 55.

The invention has significant advantages. The method enables pressure testing of the casing prior to deployment of the ESP without damaging the producing formation. The method provides for a contingency tieback of a remedial liner in the event the casing fails to meet the pressure integrity test. Once installed, the wireline deployed ESP has its intake separated from its discharge by the packer. The check valve maintains the upper casing to lower casing pressure differential. The axial sealing engagement of the ESP extension tube with the packer allows easy retrieval of the ESP. The column of well fluid above the packer serves as a pressure barrier while running and retrieving the ESP assembly. Furthermore, if workover fluid is utilized in the casing above the packer, the packer will prevent contamination of the producing formation. Once installed, the weight of the ESP will pass to the packer and casing, removing the weight imposed on the line. Once installed, the lug nipple will provide a counteraction against the torque caused by rotation of the pump.

While the invention has been shown in only one of its forms, it should be apparent to those skilled in the art that it is not so limited, but is susceptible to various changes without departing from the scope of the invention.

The invention claimed is:

1. A method of producing a well, comprising:

(a) providing a packer with a passage extending through the packer, a valve in the passage, and a tieback receptacle;

(b) setting the packer in casing of the well;

(c) applying fluid pressure to the portion of the casing above the packer to test the casing, the test being used to determine if the casing leaks; then, if the test is satisfactory, (d) lowering a submersible pump into the well, engaging an intake portion of the pump with the passage in the packer, opening the valve and operating the pump to cause well fluid to flow from below the passage, through the valve and to the surface; and, if the test of step (c) is not satisfactory, (e) before step (d) running a string of conduit into engagement with the tieback receptacle; then (f) performing step (d) by lowering the submersible pump through the conduit.

2. The method according to claim 1, wherein the pump of step (d) is powered by an electrical submersible motor.

3. The method according to claim 1, wherein, if the test of step (c) is satisfactory, the pump causes the well fluid to flow up the casing in contact with walls of the casing.

4. The method according to claim 1, wherein if the test of step (c) is not satisfactory and steps (e) and (f) are performed, the pump causes the well fluid to flow up the conduit.

5. The method according to claim 1, wherein the pump of step (d) has an electrical motor that is supplied with power through a line extending up the well to the surface; and step (d) is performed by lowering the pump on the line.

6. The method according to claim 5, further comprising retrieving the pump and the motor for repair or replacement by pulling upward on the line.

7. The method according to claim 6, wherein if pulling upward on the line fails to release the pump from the packer; then the method of retrieval of the pump comprises:

pulling on line sufficiently to cause the line to release from its connection to the submersible pump; then retrieving the line; then lowering a fishing tool into the well, engaging the submersible pump with the fishing tool and retrieving the fishing tool along with the submersible pump.

8. The method according to claim 1, wherein:

step (a) further comprises securing a tubular nipple having a protruding lug to an upper end of the packer; and step (d) comprises:

attaching an intake shroud to the pump, the intake shroud having a tubular extension on its lower end, the extension having a slot formed therein; and sliding the extension over the nipple and engaging the lug with the slot.

9. The method according to claim 1, wherein the valve in the passage in the packer is closed while performing step (c) to prevent the fluid pressure applied in step (c) from communicating with well fluid below the packer.

10. The method according to claim 1, further comprising:

retrieving the pump for repair or replacement; and and while the pump is out of disengagement with the packer, closing the valve to maintain a column of well fluid in the well above the packer as a safety barrier.

11. A method of producing a well having a casing with a set of perforations, comprising:

(a) providing a packer with a passage extending through the packer, a check valve in the passage, and a tieback receptacle;

(b) attaching a shroud around an intake of electrical submersible pump assembly, the shroud having a downward extending extension;

(c) running the packer into the casing of the well on a running string and setting the packer above the perforations;

(d) applying fluid pressure to the portion of the casing above the packer to test the casing, the test being used to determine if the casing leaks; then, if the test is satisfactory, (e) lowering the pump assembly into the well on a line, and slidingly and sealingly engaging the tubular extension with the passage in the packer; then (f) supplying power to the pump assembly via power conductors in the line to cause well fluid to flow from the perforations through the passage and up the casing around the line; and, if the test of step (d) is not satisfactory, (g) before step (e) running a liner through the casing and securing a lower end of the liner to the tieback receptacle; then (h) performing step (e) by lowering the pump assembly on the line through the liner, and performing step (f), which causes the well fluid to flow up the liner around the line.

12. The method according to claim 11, wherein:

step (a) further comprises securing a tubular nipple having a protruding lug to an upper end of the packer;

step (b) comprises providing an upward extending slot in a lower end of the tubular extension; and step (e) comprises sliding the tubular extension over the nipple and engaging the lug with the slot.

13. The method according to claim 11, further comprising:

retrieving the pump assembly for repair or replacement by pulling upward on the line.

14. The method according to claim 11, wherein if steps (g) and (h) are performed, and if pulling on the line fails to retrieve the pump assembly; then the method of retrieval of the pump assembly comprises:

manipulating the liner to release the packer from the casing, and pulling the liner and the packer from the well with the pump assembly inside the liner.

15. A method of producing a well having a casing, comprising:

(a) providing a packer with a passage extending through the packer and a tieback receptacle mounted to an upper end of the packer;

(b) attaching a shroud around an intake of an electrical submersible pump assembly, the shroud having a downward extending tubular extension;

(c) running the packer into the casing of the well and setting the packer;

(d) running a liner into the casing and securing a lower end of the liner to the tieback receptacle;

(e) lowering the pump assembly into the liner on a line and engaging the tubular extension of the shroud with the passage in the packer;

(f) supplying power to the pump assembly via power conductors in the line to cause well fluid to flow through the passage and up the liner around the line; then, when desired, (g) retrieving the pump assembly by pulling the line and the pump assembly upward through the liner.

16. The method according to claim 15, wherein:

step (a) further comprises mounting a tubular lug nipple with a protruding lug to an upper end of the packer;

step (b) comprises providing an axially extending slot in the tubular extension; and step (e) comprises sliding the tubular extension over the nipple with the lug locating in the slot.

17. The method according to claim 16, wherein step (c) comprises attaching an overshot tool having a J-slot to a running string, sliding the overshot tool over the lug nipple and positioning the lug within the J-slot to retain the packer with the running string, then lowering the running string into the well.

18. An apparatus for producing a well, comprising:

a packer for setting within casing of the well, the packer having a lug nipple extending upward from an upper end of the packer, the lug nipple having a protruding lug;

a passage extending through the packer and the lug nipple;

a check valve mounted in the passage to block downward fluid flow to enable pressure testing of the casing above the packer;

a tieback receptacle mounted to an upper end of the passage and extending around the lug nipple for receiving a liner in the event of leakage of the casing;

an electrical submersible pump assembly for lowering into the well; and a shroud enclosing at least a portion of the pump assembly and having a downward extending extension that sealing engages the lug nipple, the extension having a slot therein that receives the lug to counter torque due to rotation of the pump.

19. The apparatus according to claim 18, wherein the slot extends axially upward from a lower edge of the tubular extension so that the pump assembly can be retrieved by a straight upward pull.

20. The apparatus according to claim 18, further comprising:

a running string for running and setting the packer, the running string having an overshot tool on a lower end that slidingly engages the lug nipple and a J-slot that receives the lug to releasably retain the packer with the running string.

* * * * *